US008451179B2

(12) United States Patent
Shi et al.

(10) Patent No.: US 8,451,179 B2
(45) Date of Patent: May 28, 2013

(54) SLIDING ANTENNA APPARATUS

(75) Inventors: Guining Shi, San Diego, CA (US); Jerome Tu, Saratoga, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 766 days.

(21) Appl. No.: 12/260,444

(22) Filed: Oct. 29, 2008

(65) Prior Publication Data

US 2010/0103054 A1 Apr. 29, 2010

(51) Int. Cl.
*H01Q 1/24* (2006.01)

(52) U.S. Cl.
USPC ..... 343/702; 343/846

(58) Field of Classification Search
USPC ..... 343/702, 846; 455/575.1, 575.3, 455/575.4, 575.7, 575.8
See application file for complete search history.

(56) References Cited

U.S. PATENT DOCUMENTS

| | | | | |
|---|---|---|---|---|
| 6,208,874 | B1 * | 3/2001 | Rudisill et al. | 455/575.4 |
| 6,961,593 | B1 * | 11/2005 | Lonka et al. | 455/573 |
| 7,233,293 | B2 * | 6/2007 | Ryu et al. | 343/702 |
| 7,362,275 | B2 * | 4/2008 | Tu et al. | 343/702 |
| 7,362,579 | B2 * | 4/2008 | Cho | 361/707 |
| 7,386,332 | B2 * | 6/2008 | Masuda et al. | 455/575.4 |
| 7,554,497 | B2 * | 6/2009 | Ohba et al. | 343/702 |
| 7,663,557 | B2 * | 2/2010 | Joo et al. | 343/702 |
| 7,690,576 | B2 * | 4/2010 | Ladouceur et al. | 235/486 |
| 7,733,278 | B2 * | 6/2010 | Kanasaki et al. | 343/702 |
| 7,877,123 | B2 * | 1/2011 | Abdul-Gaffoor et al. | 455/575.4 |
| 7,904,126 | B2 * | 3/2011 | Kim et al. | 455/575.4 |
| 2008/0143616 | A1 | 6/2008 | Tu et al. | |

FOREIGN PATENT DOCUMENTS

WO 2006092979 9/2006

OTHER PUBLICATIONS

International Search Report for PCT Patent Application No. PCT/US2009/062555, mailed on May 31, 2010, 3 pgs.

* cited by examiner

*Primary Examiner* — Hoanganh Le

(57) ABSTRACT

Various embodiments of a mobile computing device are described. In one embodiment, the mobile computing device comprises an internal antenna system and a first housing coupled to a second housing by one or more electrically conductive sliding portions, the one or more electrically conductive sliding portions to operate as radiating arms for the internal antenna system. Other embodiments are described and claimed.

17 Claims, 4 Drawing Sheets

SLIDING ANTENNA APPARATUS

BACKGROUND

A wireless device typically operates using a radio transmitter/receiver ("transceiver") and one or more antennas. Antenna orientation for a given wireless device is an important design consideration and is often limited by strict performance constraints. For example, some external antenna placements may expose the antenna to potential damage and may provide reduced performance or no performance at all, when in a retracted or closed position. In addition, some internal antenna placements may be undesirable since they may increase the overall size and shape of the wireless device. Such problems may be further exacerbated for those wireless devices with smaller form factors such as a mobile telephone or handheld computer. Consequently, there may be a need for improvements in antenna design.

DETAILED DESCRIPTION

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Various embodiments may be directed to an internal antenna and sliding antenna architecture that may potentially improve the performance of a wireless device by improving one or more characteristics, such as a size, shape, form factor, power consumption, battery life, transceiver operations, signal quality, weight, and so forth. Accordingly, a user may realize enhanced products and services.

In various embodiments, the internal antenna and sliding antenna architecture may comprise an antenna system which may provide advantages in terms of industrial design, usability, and reliability for low-profile, small and compact wireless device designs. In various implementations, the antenna architecture may employ a plurality of sliding portions acting as radiating elements for the internal antenna system. Because an electrically conductive sliding portion may have a much larger physical dimension than a conventional internal antenna, the internal antenna and sliding antenna architecture may provide a wireless device with a larger antenna system without requiring extra physical volume. Other embodiments are described and claimed.

Figure 1A:
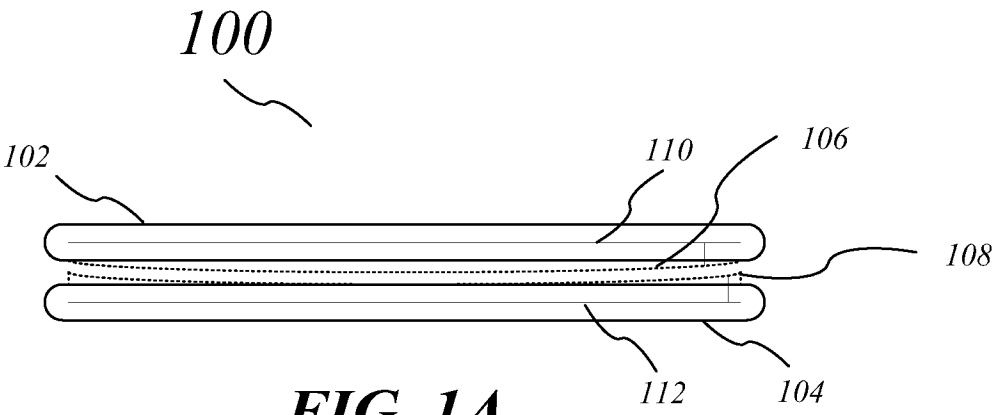
FIG. 1A illustrates one embodiment of a wireless device.
Figure 1B:
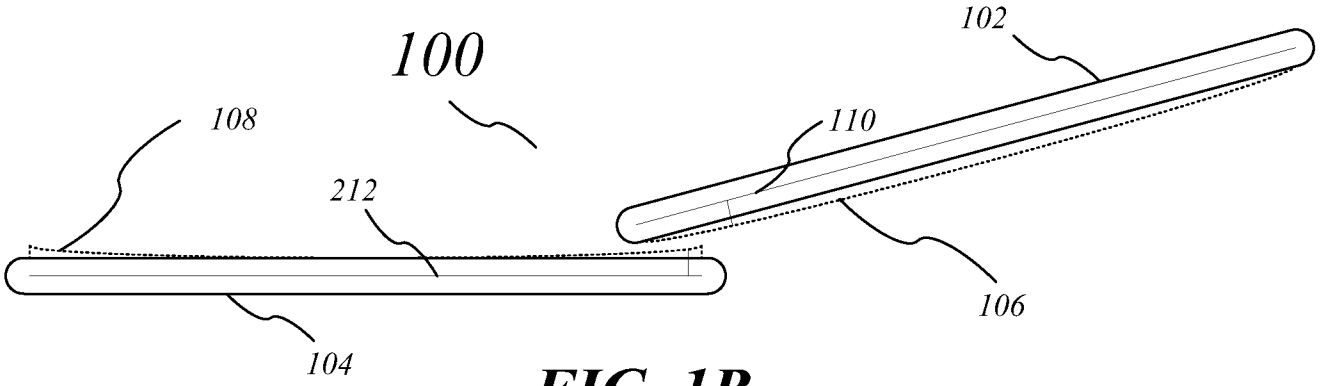
FIG. 1B illustrates one embodiment of a wireless device.

FIGS. 1A-1B illustrate one embodiment of a wireless device 100 having an internal and sliding antenna architecture. The wireless device 100 may comprise, or be implemented as, a mobile telephone, mobile computing device, handheld computer, personal digital assistant (PDA), combination mobile telephone/PDA, data transmission device, one-way pager, two-way pager, and so forth. Although some embodiments may be described with the wireless device 100 implemented as a mobile telephone or handheld computer by way of example, it may be appreciated that other embodiments may be implemented using other wireless handheld devices as well. The embodiments are not limited in this context.

As shown, the wireless device 100 may comprise a first housing 102 and a second housing 104. The housings 102 and 104 may include one or more materials such as plastic, metal, ceramic, glass, and so forth, suitable for enclosing and protecting the internal components of the wireless device 100. In various embodiments, the housing 102 may comprise an upper housing and the housing 104 may comprise a lower housing. In some embodiments, the housings 102 and 104 may be connected by one or more electrically conductive sliding portions 106 and 108. In such embodiments, the upper housing 102 and lower housing 104 may be configured to slide relative to each other. Referring to FIG. 1A, the upper housing 102 and the lower housing 104 are shown in a relatively closed position. Referring to FIG. 1B, the upper housing 102 and the lower housing 104 are shown in a relatively open position. While a particular arrangement may be shown by way of example, it can be appreciated that the housings 102 and 104 may be arranged in other ways.

In various embodiments, the electrically conductive sliding portions may comprise one or more metal tracks on the first housing 102 and one or more metal tracks on the second housing 104 that connect or couple the housings 102 and 104. The one or more metal tracks made consist of any metal material suitable for conducting electricity and also suitable for securing the upper housing 102 to the lower housing 104. In various embodiments, the one or more tracks may be made from a material other than metal and still fall within the described embodiments. For example, the tracks may be made from a material selected to reduce friction when the tracks slide relative to each other, to reduce system cost or to reduce system weight. In some embodiments, the tracks may be made from Teflon for example, and a conductive path may be created between the upper 102 and lower 104 housings via strategically placed clips, fingers or other conductive elements placed on or near the tracks. Other embodiments are described and claimed.

The one or more tracks of the first housing 102 and the one or more tracks of the second housing 104 may be engaged to enable the first 102 and second 104 housings to slide relative to each other. In some embodiments, each of the one or more tracks may comprise non-linear or curved tracks creating a radius when the first 102 and second 104 housings slide relative to each other. In some embodiments, the tracks may comprise linear or other shaped tracks and still fall within the described embodiments.

The one or more tracks may comprise spring clips, spring connectors, fingers or any other suitable device to maintain electrical connectivity between the one or more tracks when the first 102 and second 104 housings slide relative to each other in various embodiments. The spring clips, spring connectors or fingers may be located in overlapping portions of the one or more metal tracks in some embodiments. For example, the one or metal tracks may comprise overlapping portions that lock the tracks together and resist movement perpendicular to the length of the tracks while allowing movement of the tracks relative to each other in a direction parallel to the length of the tracks. Other embodiments are described and claimed.

In various embodiments, the wireless device 100 may comprise an internal antenna system configured as part of the sliding antenna system. The internal antenna system may comprise a directional internal antenna system arranged to reduce radiation in an undesired direction and focus radiation in a desired direction. In various embodiments, the internal antenna system may be arranged to transmit and/or receive electrical energy in accordance with a given set of performance or design constraints as desired for a particular implementation. During transmission, the internal antenna system may accept energy from a transmission line and radiate this energy into space via a wireless shared media. During reception, the internal antenna system may gather energy from an incident wave received over wireless shared media, and provide this energy to a corresponding transmission line. The amount of power radiated from or received by the internal antenna system is typically described in terms of gain. In addition, the antenna system may operate in accordance with a desired Voltage Standing Wave Ratio (VSWR) value. For example, VSWR relates to the impedance match of an antenna feed point with a feed line or transmission line of a communications device. To radiate radio frequency (FR) energy with minimum loss, or to pass along received RF energy to a wireless receiver with minimum loss, impedance may be matched to the impedance of a transmission line or feed point of a PCB.

The internal antenna system may be tuned for operating at one or more frequency bands. For example, the internal antenna system may allow the wireless device 100 to operate in the 824-894 Megahertz (MHz) frequency band for GSM operations, the 1850-1990 MHz frequency band for Personal Communications Services (PCS) operations, the 1575 MHz frequency band for Global Positioning System (GPS) operations, the 824-860 MHz frequency band for NAMPS operations, the 1710-2170 MHz frequency band for WCDMA/UMTS operations, and other frequency bands. This may be desirable since the wireless device 100 may be compatible with multiple wireless data, multimedia and cellular telephone systems. In addition, the internal antenna system may be used to implement various spatial diversity techniques to improve communication of wireless signals across one or more frequency bands of wireless shared media. In various embodiments, for example, the internal antenna system may be designed for Evolution Data Optimized (EVDO) diversity at both the 800 MHz band (cellular) and the 1900 MHz (PCS). The embodiments are not limited in this context.

In various embodiments, the internal antenna system may comprise a first ground plane and a first motherboard 110 in the first housing 102 and a second ground plane and a second motherboard 112 in the second housing 104. In some embodiments, the first ground plane 110, the first motherboard 110, the second ground plane 112 or the second motherboard 112 may be coupled to the one or more electrically conductive sliding portions 106, 108 to enhance the antenna architecture for wireless device 100. For example, the first ground plane 110, the first motherboard 110, the second ground plane 112 or the second motherboard 112 may act as radiating arms for the internal antenna system in addition to the electrically conductive sliding portions 106, 108 acting as radiating arms for the antenna system. Other embodiments are described and claimed.

The wireless device 100 may comprise a plurality of motherboards, such as a first motherboard 110 and a second motherboard 112. As shown, the upper housing 102 may comprise the first motherboard 110, and the lower housing 104 may comprise the second motherboard 112. In various embodiments, the first motherboard 110 and/or the second motherboard 112 may comprise a printed circuit board (PCB). The PCB may comprise materials such as FR4, Rogers R04003, and/or Roger RT/Duroid, for example, and may include one or more conductive traces, via structures, and/or laminates. The PCB also may include a finish such as Gold, Nickel, Tin, or Lead. In various implementations, the PCB may be fabricated using processes such as etching, bonding, drilling, and plating.

Conductive traces of the PCB may be formed by chemical etching, metal etching, and other similar techniques. The traces may have any suitable pattern or geometry tuned for various operating frequencies. For example, the traces may comprise one or more center lines and/or branch lines. Phase lines and/or various chip components, such as resistors, capacitors or inductors, may be used among the center lines and/or branch lines. The different elements may be contacted or parasitic.

The wireless device 100 may comprise a plurality of ground planes, such as a first ground plane 110 and a second ground plane 112. As shown, the first ground plane 110 and the second ground plane 112 may be configured as part of the first motherboard 110 and the second motherboard 112. In some embodiments, the ground planes 110, 112 may be formed separate from the motherboards 110, 112 and still fall within the described embodiments.

The first ground plane 110 and the second ground plane 112 may comprise, for example, a layer of copper or other plating metal connected to ground. In various embodiments, the first motherboard 110 and/or the second motherboard 112 may comprise a multi-layer PCB including one or more signal planes, power planes, and ground planes. The actual number of layers and/or planes, and the length of each individual layer and/or plane, may vary for a particular implementation.

In various embodiments, the ground planes/motherboards 110, 112 may be coupled within the wireless device 100. As shown in FIGS. 1A and 1B, for example, the ground planes/motherboards 110, 112 may be coupled through the electrically conductive sliding portions 106, 108 to form a continuous electrical connection including both halves of wireless device 100. In various implementations, the coupling may comprise one or more coupled transmission lines, wires, cables, circuitry, semiconductor materials, and/or other medium capable of carrying signals.

In various embodiments, the electrically conductive sliding portions 106, 108, the first motherboard 110 and the second motherboard 112 may comprise, or form part of, an antenna system for the wireless device 100. In various implementations, by virtue of the physics of antenna design and electromagnetic theory and the coupling of the first ground plane 110 to the second ground plane 112, the first motherboard 110 and the second motherboard 112 may act as radiating elements of the internal antenna system along with the electrically conductive sliding portion 106, 108 radiating elements. For example, the first motherboard 110 may act as a first radiator arm of the internal antenna system, and the second motherboard 112 may act as a second radiating arm of the internal antenna system, along with the radiating arms of the electrically conductive sliding portions 106, 108. Because the electrically conductive sliding elements 106, 108 along with the ground planes and/or the motherboards 110, 112 may have larger physical dimensions than conventional internal antennas, the wireless device 100 may comprise a relatively larger antenna system without requiring extra physical volume.

Figure 2A:
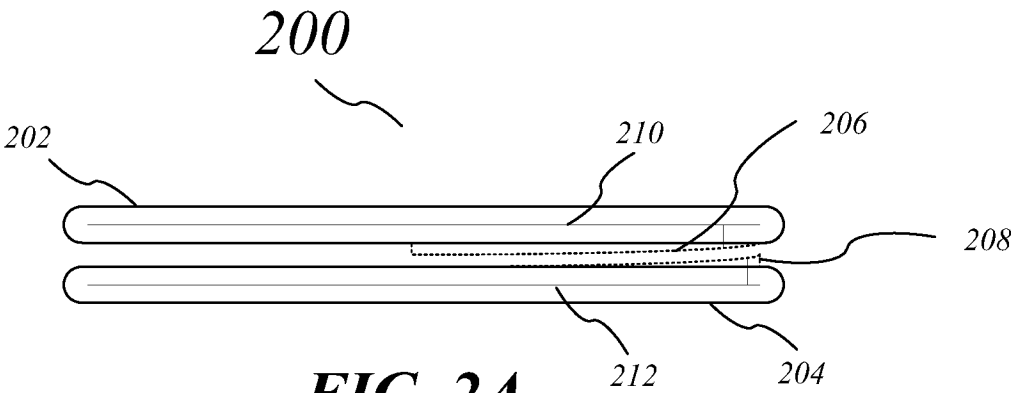
FIG. 2A illustrates one embodiment of a wireless device.
Figure 2B:
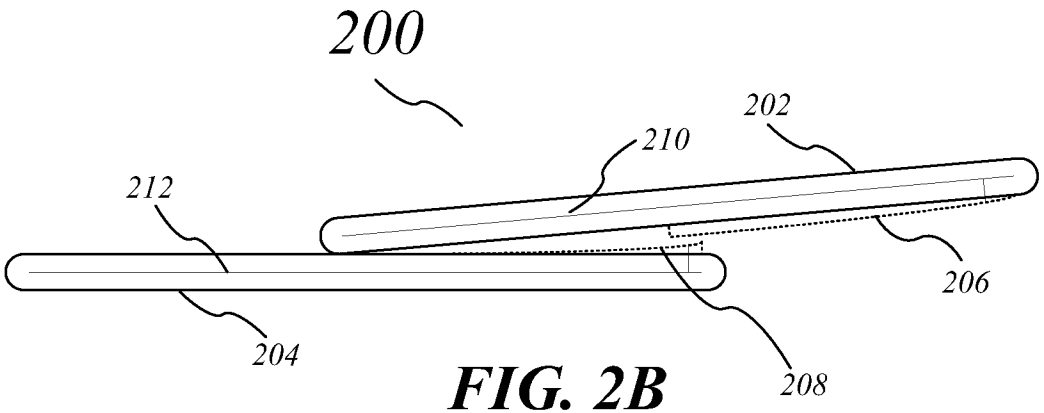
FIG. 2B illustrates one embodiment of a wireless device.

FIGS. 2A-2B illustrate one embodiment of a wireless device 200 having an internal antenna and sliding antenna architecture. The wireless device 200 may be similar to wireless device 100 described above with reference to FIGS. 1A-1B. As shown, the wireless device 200 may comprise a first housing 202, a second housing 204 and sliding portions 206 and 208. The housings 202 and 204 and sliding portions 206 and 208 may be similar to housings 102 and 104 and sliding portions 106 and 108 described above with reference to FIGS. 1A-1B. Wireless device 200 may also comprise motherboard/ground plane 210 and motherboard/ground plane 212, similar to motherboard/ground plane 110 and motherboard/ground plane 112 of FIGS. 1A-1B. Other embodiments are described and claimed.

As shown, sliding portions 206 and 208 may comprise different length sliding portions than sliding portions 106 and 108. For example, sliding portions 206 and 208 restrict the distance in which upper housing 202 and lower housing 204 can slide relative to one another. While a limited number of lengths are illustrated for the electrically conductive sliding portions, 106, 108, 206, 208, it should be understood that any length sliding portion could be used and still fall within the described embodiments. Additionally, while the wireless devices 100 and 200 shown in FIGS. 1A-B and 2A-2B comprise embodiments of an antenna architecture, it can be appreciated that the size, placement or location of the motherboards/ground planes 110, 112, 210, 212 and the electrically conductive sliding portions 106, 108, 206, 208 may be implemented in accordance with various performance and design constraints. For example, the efficiency of the antenna system may depend upon a proper relationship between the size and shape of the various components and the wavelength of the targeted frequency. The specific frequency range that the antenna system is designed to cover may dictate the optimal size of the components. Therefore, the specific implementation of the antenna system may vary depending upon such factors as the target operating frequencies, power consumption requirements, battery life, a form factor of the wireless device, transceiver operations, signal quality, weight considerations of the wireless devices 100 and 200, and so forth.

For example, in various embodiments, the one or more electrically conductive sliding portions 106, 108, 206, 208 are connected to establish predetermined conductive lengths when the first and second housings 102, 104, 202, 204 are in the open and closed positions. In some embodiments, the predetermined conductive lengths may comprise fractions of wavelengths, such as a quarter wavelength for example.

In various implementations, the motherboards/ground planes 110, 112, 210, 212 and electrically conductive sliding portions 106, 108, 206, 208 may be spatially separated by a predetermined amount, such as a fraction of a wavelength, for example. In certain directions, signals radiated from the radiating elements may add constructively resulting in a lobe or stronger antenna pattern. In other directions, radiated signals may add destructively resulting in a null or weak antenna pattern. The number of lobes and/or nulls may depend on the number of radiating elements, the physical separation between radiating elements, the wavelength of the radio signal, and/or phase of the radio signal.

Figure 3B:
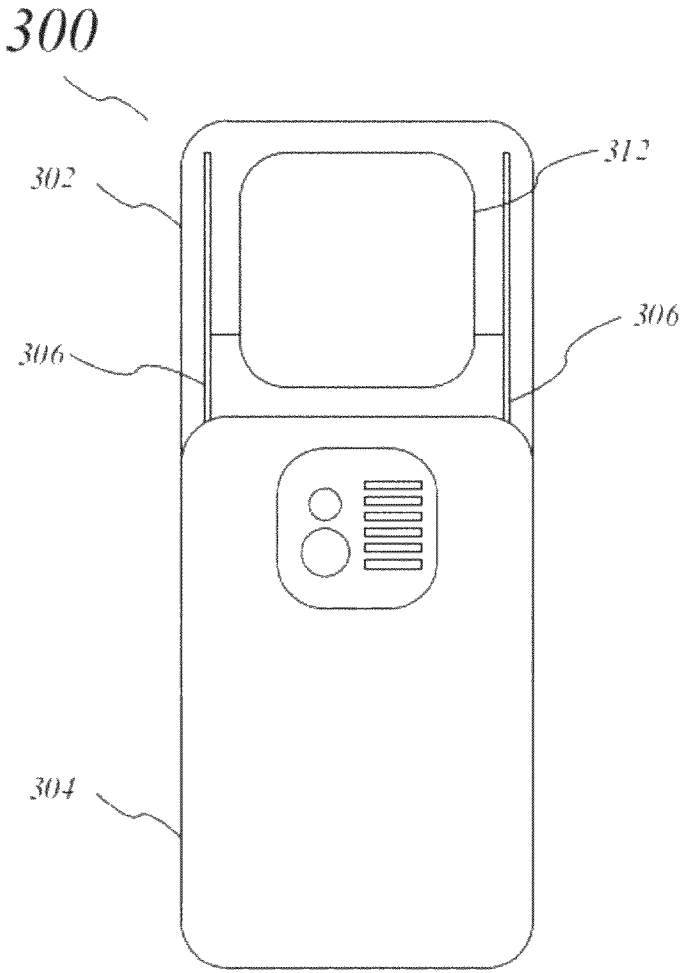
FIG. 3B illustrates one embodiment of a wireless device.
Figure 3A:
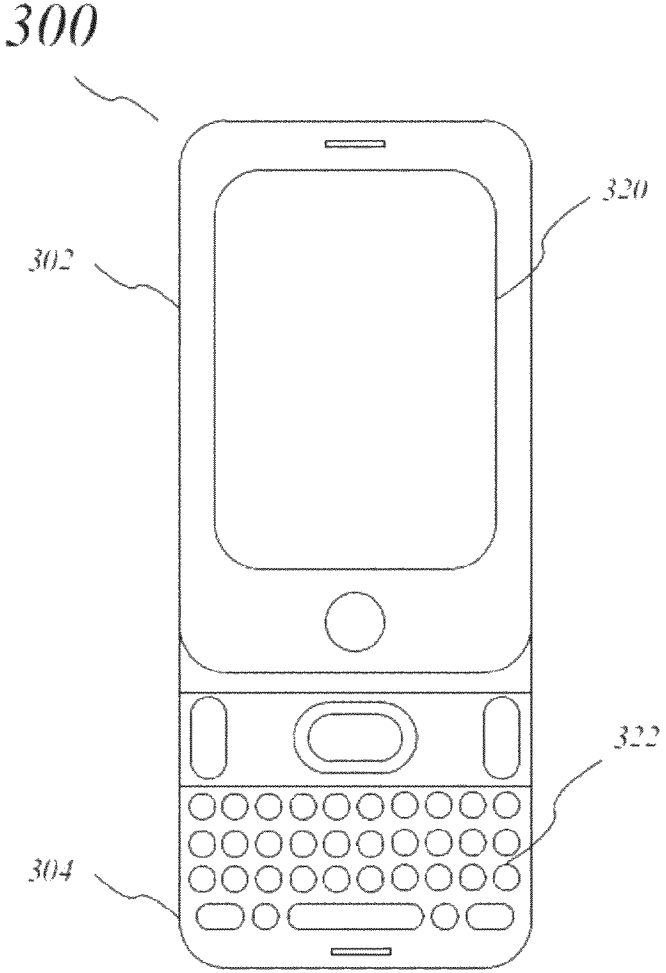
FIG. 3A illustrates one embodiment of a wireless device.

FIGS. 3A-3B illustrate one embodiment of a wireless device 300. FIG. 3A illustrates a front or top view of the wireless device 300. As shown, wireless device 300 may include a first or upper housing 302 and a second or lower housing 304 that are slidably connected and moveable as illustrated and described with references to FIGS. 1A-1B and 2A-2B.

Upper housing 302 may include a display 320 in various embodiments. Display 320 may comprise any suitable visual interface for displaying content to a user of the wireless device 300. In one embodiment, for example, the display 320 may be implemented by a LCD such as a touch-sensitive color (e.g., 16-bit color) thin-film transistor (TFT) LCD screen. In some embodiments, the touch-sensitive LCD may be used with a stylus and/or a handwriting recognizer program. Other embodiments are described and claimed.

In some embodiments, lower housing 304 may include a keyboard 322. Keyboard 322 may comprise any keyboard, keypad or thumb board suitable for entering information into wireless device 300. For example, keyboard 322 may comprise a QWERTY keyboard in various embodiments.

FIG. 3A illustrates a front or top view of wireless device 300 in an open position. In various embodiments, the first and second housings 302, 304 are slidably movable relative to one another between an open position, FIG. 3A, and a closed position wherein the display 320 is visible when the first and second housings 302, 304 are in the open and closed positions and the keyboard 322 is visible when the first and second housings 302, 304 are in the open position. In this manner, keyboard 322 is substantially concealed and inaccessible when housings 302, 304 are in the closed position. Display 320 is visible and accessible in both the open and closed positions. In various embodiments, wireless device 300 is operable in both the open and closed positions.

FIG. 3B illustrates a back or bottom view of wireless device 300 in an open position. As shown, upper housing 302 may include electrically conductive sliding portions 306. While not shown, it should be understood that lower housing 304 includes electrically conductive sliding portions to receive electrically conductive sliding portions 306 and couple upper housing 302 to lower housing 304 and allow upper housing 302 and lower housing 304 to slide relative to each other.

In various embodiments, a portion of the one or more electrically conductive sliding portions 306 are exposed when the first and second housings 302 and 304 are in the open position. In this manner, the antenna system for wireless device 300 may be improved in that exposure of a portion of the electrically conductive sliding portions 306 may enhance the reception or radiation of these radiating elements.

In some embodiments, the material used for electrically conductive sliding portions 306 may be selected or finished to enhance the visual appearance of wireless device 300, in addition to enhancing the antenna capabilities of the wireless device. For example, electrically conductive sliding portions 306 may be polished, painted or otherwise finished to achieve a desired look while maintaining electrical connectively and coupling of the housings 302, 304. Other embodiments are described and claimed.

Upper housing 302 may include a mirrored surface 312 located on a side opposite the display 320 in various embodiments. For example, the mirrored surface 312 may be visible when the first and second housings 302, 304 are in the open position. Mirrored surface 312 may comprise any material suitable for reflecting an image. In various embodiments, mirrored surface 312 may comprise or be backed with an electrically conductive material and may be connected to sliding portions 306 to enhance the size of the radiating elements of the antenna system for wireless device 300. Other embodiments are described and claimed.

Figure 4:
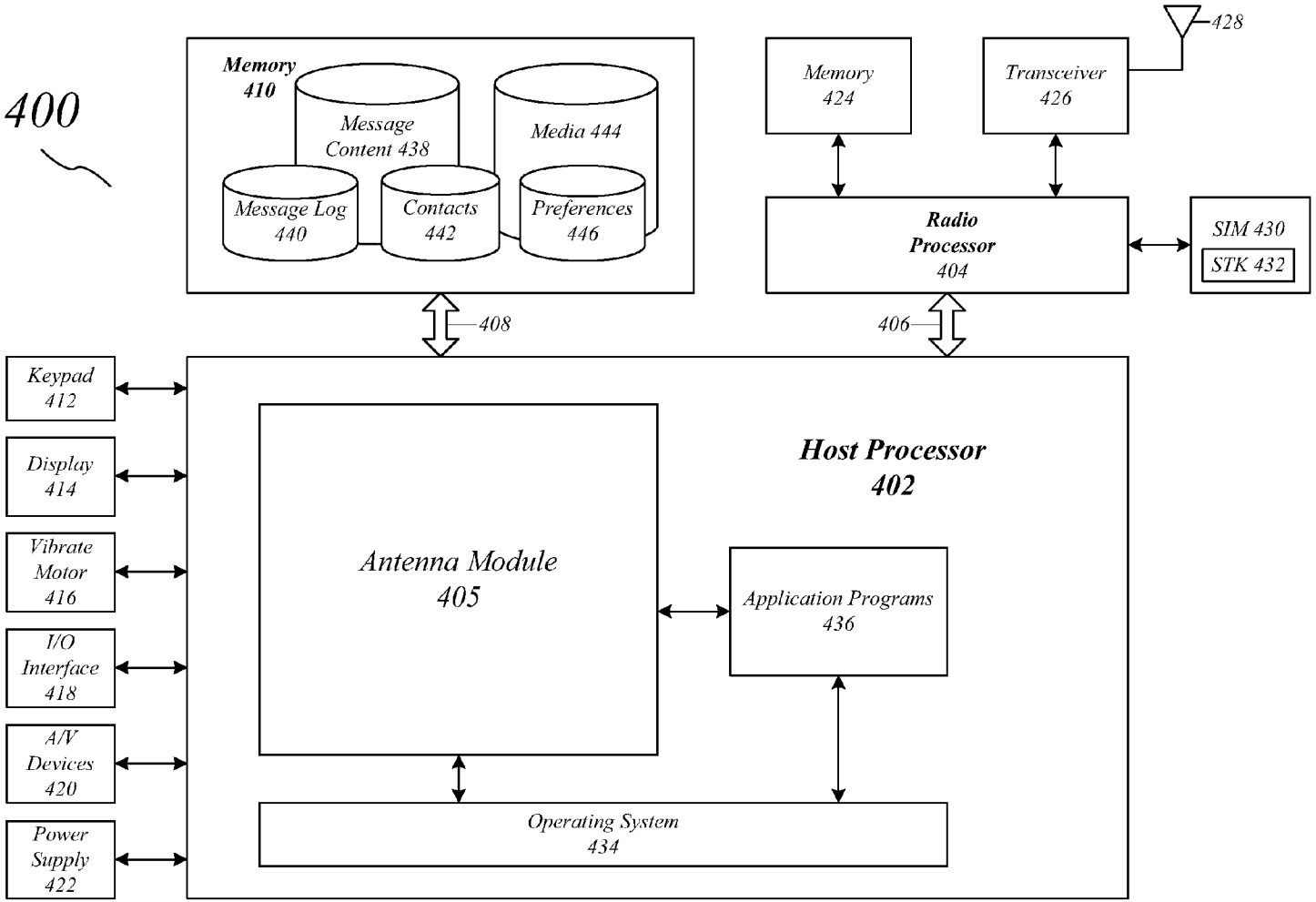
FIG. 4 illustrates one embodiment of a wireless device.

FIG. 4 illustrates a block diagram of a mobile computing device 400 suitable for implementing various embodiments, including the mobile computing device 100. It may be appreciated that the mobile computing device 400 is only one example of a suitable mobile computing environment and is not intended to suggest any limitation as to the scope of use or functionality of the embodiments. Neither should the mobile computing device 400 be interpreted as having any dependency or requirement relating to any one or combination of components illustrated in the exemplary mobile computing device 400.

The host processor 402 (e.g., similar to the processor 102) may be responsible for executing various software programs such as system programs and applications programs to provide computing and processing operations for the mobile computing device 400. The radio processor 404 may be responsible for performing various voice and data communications operations for the mobile computing device 400 such as transmitting and receiving voice and data information over one or more wireless communications channels. Although the mobile computing device 400 is shown with a dual-processor architecture, it may be appreciated that the mobile computing device 400 may use any suitable processor architecture and/or any suitable number of processors in accordance with the described embodiments. In one embodiment, for example, the processors 402, 404 may be implemented using a single integrated processor.

The host processor 402 may be implemented as a host central processing unit (CPU) using any suitable processor or logic device, such as a as a general purpose processor. The host processor 402 may also be implemented as a chip multiprocessor (CMP), dedicated processor, embedded processor, media processor, input/output (I/O) processor, co-processor, microprocessor, controller, microcontroller, application specific integrated circuit (ASIC), field programmable gate array (FPGA), programmable logic device (PLD), or other processing device in accordance with the described embodiments.

As shown, the host processor 402 may be coupled through a memory bus 408 to a memory 410. The memory bus 408 may comprise any suitable interface and/or bus architecture for allowing the host processor 402 to access the memory 410. Although the memory 410 may be shown as being separate from the host processor 402 for purposes of illustration, it is worthy to note that in various embodiments some portion or the entire memory 410 may be included on the same integrated circuit as the host processor 402. Alternatively, some portion or the entire memory 410 may be disposed on an integrated circuit or other medium (e.g., hard disk drive) external to the integrated circuit of the host processor 402. In various embodiments, the mobile computing device 400 may comprise an expansion slot to support a multimedia and/or memory card, for example.

The memory 410 may be implemented using any computer-readable media capable of storing data such as volatile or non-volatile memory, removable or non-removable memory, erasable or non-erasable memory, writeable or re-writeable memory, and so forth. Examples of computer-readable storage media may include, without limitation, random-access memory (RAM), dynamic RAM (DRAM), Double-Data-Rate DRAM (DDRAM), synchronous DRAM (SDRAM), static RAM (SRAM), read-only memory (ROM), programmable ROM (PROM), erasable programmable ROM (EPROM), electrically erasable programmable ROM (EEPROM), flash memory (e.g., NOR or NAND flash memory), content addressable memory (CAM), polymer memory (e.g., ferroelectric polymer memory), phase-change memory, ovonic memory, ferroelectric memory, silicon-oxide-nitride-oxide-silicon (SONOS) memory, magnetic or optical cards, or any other type of media suitable for storing information.

The mobile computing device 400 may comprise an alphanumeric keypad 412 coupled to the host processor 402. The keypad 412 may comprise, for example, a QWERTY key layout and an integrated number dial pad. The mobile computing device 400 also may comprise various keys, buttons, and switches such as, for example, input keys, preset and programmable hot keys, left and right action buttons, a navigation button such as a multidirectional navigation button, phone/send and power/end buttons, preset and programmable shortcut buttons, a volume rocker switch, a ringer on/off switch having a vibrate mode, and so forth. The keypad 412 may comprise a physical keypad using hard buttons, or a virtual keypad using soft buttons displayed on a display 414. The keypad may also comprise a thumbboard.

The mobile computing device 400 may comprise a display 414 coupled to the host processor 402. The display 414 may comprise any suitable visual interface for displaying content to a user of the mobile computing device 400. In one embodiment, for example, the display 414 may be implemented by a liquid crystal display (LCD) such as a touch-sensitive color (e.g., 46-bit color) thin-film transistor (TFT) LCD screen. The touch-sensitive LCD may be used with a stylus and/or a handwriting recognizer program.

The mobile computing device 400 may comprise a vibrate motor 416 coupled to the host processor 402. The vibrate motor 416 may be enable or disabled according to the preferences of the user of the mobile computing device 400. When enabled, the vibrate motor 416 may cause the mobile computing device 400 to move or shake in a generic and/or patterned fashion in response to a triggering event such as the receipt of a telephone call, text message, an alarm condition, a game condition, and so forth. Vibration may occur for a fixed duration and/or periodically according to a pulse.

The mobile computing device 400 may comprise an input/output (I/O) interface 418 coupled to the host processor 402. The I/O interface 418 may comprise one or more I/O devices such as a serial connection port, an infrared port, integrated Bluetooth wireless capability, and/or integrated 802.11x (e.g. 802.11b, 802.11g, 802.11a, 802.11n, etc.) (WiFi) wireless capability, to enable wired (e.g., USB cable) and/or wireless connection to a local computer system, such as a local personal computer (PC). In various implementations, mobile computing device 400 may be arranged to synchronize information with a local computer system.

The host processor 402 may be coupled to various audio/video (A/V) devices 420 that support A/V capability of the mobile computing device 400. Examples of A/V devices 420 may include, for example, a microphone, one or more speakers (such as speaker system 108), an audio port to connect an audio headset, an audio coder/decoder (codec), an audio player, a Musical Instrument Digital Interface (MIDI) device, a digital camera, a video camera, a video codec, a video player, and so forth.

The host processor 402 may be coupled to a power supply 422 arranged to supply and manage power to the elements of the mobile computing device 400. In various embodiments, the power supply 422 may be implemented by a rechargeable battery, such as a removable and rechargeable lithium ion battery to provide direct current (DC) power, and/or an alternating current (AC) adapter to draw power from a standard AC main power supply.

The radio processor 404 may be arranged to communicate voice information and/or data information over one or more assigned frequency bands of a wireless communication channel. The radio processor 404 may be implemented as a communications processor using any suitable processor or logic device, such as a modem processor or baseband processor. The radio processor 404 may also be implemented as a digital signal processor (DSP), media access control (MAC) processor, or any other type of communications processor in accordance with the described embodiments. The radio processor 404 may perform analog and/or digital baseband operations for the mobile computing device 400. For example, the radio processor 404 may perform digital-to-analog conversion (DAC), analog-to-digital conversion (ADC), modulation, demodulation, encoding, decoding, encryption, decryption, and so forth.

The mobile computing device 400 may comprise a memory 424 coupled to the radio processor 404. The memory 424 may be implemented using any of the computer-readable media described with reference to the memory 410. The memory 424 may be typically implemented as flash memory and synchronous dynamic random access memory (SDRAM). Although the memory 424 may be shown as being separate from the radio processor 404, some or all of the memory 424 may be included on the same IC as the radio processor 404.

The mobile computing device 400 may comprise a transceiver module 426 coupled to the radio processor 404. The transceiver module 426 may comprise one or more transceivers arranged to communicate using different types of protocols, communication ranges, operating power requirements, RF sub-bands, information types (e.g., voice or data), use scenarios, applications, and so forth. In various embodiments, the transceiver module 426 may comprise one or more transceivers arranged to support voice communications and/or data communications for the wireless network systems or protocols as previously described. In some embodiments, the transceiver module 426 may further comprise a Global Positioning System (GPS) transceiver to support position determination and/or location-based services.

The transceiver module 426 generally may be implemented using one or more chips as desired for a given implementation. Although the transceiver module 426 may be shown as being separate from and external to the radio processor 404 for purposes of illustration, it is worthy to note that in various embodiments some portion or the entire transceiver module 426 may be included on the same integrated circuit as the radio processor 404. The embodiments are not limited in this context.

The mobile computing device 400 may comprise an antenna system 428 for transmitting and/or receiving electrical signals. As shown, the antenna system 428 may be coupled to the radio processor 404 through the transceiver module 426. The antenna system 428 may comprise or be implemented as one or more internal antennas and/or external antennas.

The mobile computing device 400 may comprise a subscriber identity module (SIM) 430 coupled to the radio processor 404. The SIM 430 may comprise, for example, a removable or non-removable smart card arranged to encrypt voice and data transmissions and to store user-specific data for allowing a voice or data communications network to identify and authenticate the user. The SIM 430 also may store data such as personal settings specific to the user. In some embodiments, the SIM 430 may be implemented as an UMTS universal SIM (USIM) card or a CDMA removable user identity module (RUIM) card. The SIM 430 may comprise a SIM application toolkit (STK) 432 comprising a set of programmed commands for enabling the SIM 430 to perform various functions. In some cases, the STK 432 may be arranged to enable the SIM 430 to independently control various aspects of the mobile computing device 400.

As mentioned above, the host processor 402 may be arranged to provide processing or computing resources to the mobile computing device 400. For example, the host processor 402 may be responsible for executing various software programs including system programs such as operating system (OS) 434 and application programs 436. System programs generally may assist in the running of the mobile computing device 400 and may be directly responsible for controlling, integrating, and managing the individual hardware components of the computer system. The OS 434 may be implemented, for example, as a Palm OS®, Palm OS® Cobalt, Microsoft® Windows OS, Microsoft Windows® CE OS, Microsoft Pocket PC OS, Microsoft Mobile OS, Symbian OS™, Embedix OS, Linux OS, Binary Run-time Environment for Wireless (BREW) OS, JavaOS, a Wireless Application Protocol (WAP) OS, or other suitable OS in accordance with the described embodiments. The mobile computing device 400 may comprise other system programs such as device drivers, programming tools, utility programs, software libraries, application programming interfaces (APIs), and so forth.

Application programs 436 generally may allow a user to accomplish one or more specific tasks. In various implementations, the application programs 436 may provide one or more graphical user interfaces (GUIs) to communicate information between the mobile computing device 400 and a user. In some embodiments, application programs 436 may comprise upper layer programs running on top of the OS 434 of the host processor 402 that operate in conjunction with the functions and protocols of lower layers including, for example, a transport layer such as a Transmission Control Protocol (TCP) layer, a network layer such as an Internet Protocol (IP) layer, and a link layer such as a Point-to-Point (PPP) layer used to translate and format data for communication.

Examples of application programs 436 may include, without limitation, messaging applications, web browsing applications, personal information management (PIM) applications (e.g., contacts, calendar, scheduling, tasks), word processing applications, spreadsheet applications, database applications, media applications (e.g., video player, audio player, multimedia player, digital camera, video camera, media management), gaming applications, and so forth. Messaging applications may be arranged to communicate various types of messages in a variety of formats. Examples of messaging applications may include without limitation a cellular telephone application, a Voice over Internet Protocol (VoIP) application, a Push-to-Talk (PTT) application, a voicemail application, a facsimile application, a video teleconferencing application, an IM application, an e-mail application, an SMS application, an MMS application, and so forth. It is also to be appreciated that the mobile computing device 400 may implement other types of applications in accordance with the described embodiments.

The host processor 402 may include an antenna module 405. The antenna module 405 may be configured to control the antenna systems described above with reference to FIGS. 1A-1B, 2A-2B and 3A-3B. Other embodiments are described and claimed.

The mobile computing device 400 may include various databases implemented in the memory 410. For example, the mobile computing device 400 may include a message content database 438, a message log database 440, a contacts database 442, a media database 444, a preferences database 446, and so forth. The message content database 438 may be arranged to store content and attachments (e.g., media objects) for various types of messages sent and received by one or more messaging applications. The message log 440 may be arranged to track various types of messages which are sent and received by one or more messaging applications. The contacts database 442 may be arranged to store contact records for individuals or entities specified by the user of the mobile computing device 400. The media database 444 may be arranged to store various types of media content such as image information, audio information, video information, and/or other data. The preferences database 446 may be arranged to store various settings such as rules and parameters for controlling the operation of the mobile computing device 400.

In some cases, various embodiments may be implemented as an article of manufacture. The article of manufacture may include a storage medium arranged to store logic and/or data for performing various operations of one or more embodiments. Examples of storage media may include, without limitation, those examples as previously described. In various embodiments, for example, the article of manufacture may comprise a magnetic disk, optical disk, flash memory or firmware containing computer program instructions suitable for execution by a general purpose processor or application specific processor. The embodiments, however, are not limited in this context.

Various embodiments may be implemented using hardware elements, software elements, or a combination of both. Examples of hardware elements may include any of the examples as previously provided for a logic device, and further including microprocessors, circuits, circuit elements (e.g., transistors, resistors, capacitors, inductors, and so forth), integrated circuits, logic gates, registers, semiconductor device, chips, microchips, chip sets, and so forth. Examples of software elements may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints, as desired for a given implementation.

Some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

It is emphasized that the Abstract of the Disclosure is provided to comply with 37 C.F.R. Section 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A mobile computing device comprising:

a first housing coupled with a second housing by one or more electrically conductive sliding portions, the first housing comprising a first ground plane, a first motherboard and an electrically conductive mirrored surface, and the second housing comprising a second ground plane and a second motherboard, the first ground plane, the first motherboard, the electrically conductive mirrored surface, the second ground plane and the second motherboard coupled with the one or more electrically conductive sliding portions to form a continuous electrical connection; and an internal antenna system for the mobile computing device, the first ground plane, the first motherboard, the electrically conductive mirrored surface, the second ground plane or the second motherboard to operate as radiating arms for the internal antenna system.

2. The mobile computing device of claim 1, the one or more electrically conductive sliding portions comprising one or more metal tracks on the first housing and one or more metal tracks on the second housing, the one or more tracks of the first housing and the one or more tracks of the second housing engaged to enable the first and second housings to slide relative to each other.

3. The mobile computing device of claim 2, each of the one or more metal tracks comprising curved tracks that create a radius when the first and second housings slide relative to each other.

4. The mobile computing device of claim 2, the one or more metal tracks comprising spring clips, spring connectors or fingers that maintain electrical connectivity between the one or more metal tracks when the first and second housings slide relative to each other.

5. The mobile computing device of claim 4, the spring clips, spring connectors or fingers are located in overlapping portions of the one or more metal tracks.

6. A mobile computing device, comprising:

a display on a first housing, the first housing comprising a first ground plane, a first motherboard, and an electrically conductive mirrored surface; and a keyboard on a second housing, the second housing comprising a second ground plane and a second motherboard, the first ground plane, the first motherboard, the electrically conductive mirrored surface, the second ground plane and the second motherboard coupled with one or more electrically conductive sliding portions to form a continuous electrical connection;

the first and second housings slidably movable relative to one another between an open position and a closed position wherein the display is visible when the first and second housings are in the open and closed positions and the keyboard is visible when the first and second housings are in the open position.

7. The mobile computing device of claim 6, wherein a portion of the one or more electrically conductive sliding portions are exposed when the first and second housings are in the open position.

8. The mobile computing device of claim 6, the electrically conductive mirrored surface located on the first housing on a side of the first housing opposite the display, the electrically conductive mirrored surface visible when the first and second housings are in the open position.

9. The mobile computing device of claim 6, the one or more electrically conductive sliding portions are connected to establish predetermined conductive lengths when the first and second housings are in the open and closed positions.

10. The mobile computing device of claim 9, the predetermined conductive lengths comprise fractions of wavelengths.

11. An internal antenna system for a mobile computing device comprising:

one or more conductive tracks on a first housing and one or more conductive tracks on a second housing to act as radiating arms for the internal antenna system, the first housing comprising a first ground plane, a first motherboard and an electrically conductive mirrored surface, and the second housing comprising a second ground plane and a second motherboard, the first ground plane, the first motherboard, the electrically conductive mirrored surface, the second ground plane and the second motherboard coupled with the one or more electrically conductive tracks to form a continuous electrical connection, the one or more conductive tracks of the first housing and the one or more conductive tracks of the second housing are engaged to enable the first and second housings to slide relative to each other between open and closed positions.

12. The internal antenna system of claim 11, each of the one or more conductive tracks comprising non-linear or curved tracks that create a radius when the first and second housings slide relative to each other.

13. The internal antenna system of claim 12, the one or more conductive tracks comprising spring clips, spring connectors or fingers that maintain electrical connectivity between the one or more conductive tracks when the first and second housings slide relative to each other.

14. The internal antenna system of claim 13, the spring clips, spring connectors or fingers are located in overlapping portions of the one or more conductive tracks.

15. The internal antenna system of claim 11, wherein a portion of the one or more conductive tracks are exposed when the first and second housings are in the open position.

16. The internal antenna system of claim 11, the one or more conductive tracks are connected to establish predetermined conductive lengths when the first and second housings are in the open and closed positions.

17. The internal antenna system of claim 16, the predetermined conductive lengths comprise fractions of wavelengths.

* * * * *